United States Patent [19]

Best Available Copy

Leuchs et al.

[11] 4,297,526

[45] Oct. 27, 1981

[54] FIRE RESISTANT ELECTRICAL CABLES

[75] Inventors: Ottmar Leuchs, Hannover-Bothfeld; Georg Maltz, Burgdorf, both of Fed. Rep. of Germany

[73] Assignee: Kabel-und Metallwerke Gutehoffnungshuette A.G., Hanover, Fed. Rep. of Germany

[21] Appl. No.: 119,532

[22] Filed: Feb. 7, 1980

[30] Foreign Application Priority Data

Feb. 26, 1979 [DE] Fed. Rep. of Germany ..... 2907473

[51] Int. Cl.[3] ..... H01B 7/20; H01B 7/28

[52] U.S. Cl. ..... 174/102 R; 174/102 D; 174/121 A

[58] Field of Search ..... 174/102, 102 D, 121 A

[56] References Cited

U.S. PATENT DOCUMENTS 2,808,450 10/1953 Peters ..... 174/102 D

*Primary Examiner*—Elliot A. Goldberg

*Attorney, Agent, or Firm*—Martin A. Farber

[57] ABSTRACT

An insulated cable has a hermetically enclosed sheath. Between the sheath and the insulation of the cable is a filler of a thermoplastic material. When the cable is heated (e.g. a localized fire) gases and acids that are given off by the insulation are absorbed by the filler which also expands resulting in a structural blockage to the longitudinal flow of the acids and gases.

5 Claims, 3 Drawing Figures

FIRE RESISTANT ELECTRICAL CABLES

The invention is directed to an improved fire resistant electrical cable; more particularly, to an electrical cable that includes a filler material which emits extinguishing oxides, and expands in volume to restrict to a localized area the effects of insulation decomposition resulting from the application of concentrated heat; e.g., a fire, to a particular segment of the cable. Electrical cables comprising a core assembly, including at least one insulated conductor and a hermetically closed tubular metallic sheath concentrically positioned about the core assembly, are known to the prior art. Such electrical cables form a general category encompassing the following specific types: high voltage power cables and communication cables. The core assembly of such electrical cables may comprise a plurality of conductors, each of which may be typically insulated by paper or plastic materials. These insulating materials are combustible and often give rise to extensive fire damage to the cable itself and to the immediate surrounding areas. The hermetically closed, tubular metallic sheaths of such electrical cables may have a smooth or corrugated tubular configuration depending upon flexibility and other intended use considerations, and may be comprised, for example, of copper, aluminum, steel or lead. Usually a protective jacket is extruded about the metallic sheath, the jacket being comprised of insulating material. The aforesaid electrical cables must not only be structured to provide the necessary electrical characteristics, but must be resistant to mechanical as well as fire damage.

In the electrical industry, plasticized polyvinyl chloride is commonly used as an insulation or jacketing for electrical cables or conductors; and at elevated temperatures, the chlorine content thereof is converted to gaseous hydrogen chloride. The gaseous hydrogen chloride tends to extinguish any flames, and consequently, the polyvinyl chloride compositions generally used for such applications, are flameproof. These compositions, however, are disadvantageous in that the evolved hydrogen chloride will combine with water or water vapor and corrode, destroy and/or impair any metal, masonry or other sensitive material in the vicinity of the evolved compounds. These adverse effects are particularly serious in areas where highly sensitive metal elements such as switch contacts or other sensitive control equipment is present. Further, in confined areas, the evolved corrosive compounds may be present in amounts sufficient to prevent access to such areas for the purpose of extinguishing flames or the like. The use of such electrical cables employing polyvinyl chloride as an insulating material in vertical shafts of buildings, is especially dangerous since a fire can rapidly spread in such shafts or in the cable itself over a plurality of levels.

Electrical cables comprising hermetically closed, tubular metallic sheaths have advantageous fire resistant characteristics in that the efficient longitudinal heat conductance of the metallic sheath will initially diffuse the effects of the application of concentrated heat to a particular segment of the electrical cable, and thus divert the effects of the concentrated heat away from the core assembly. However, the continued application of such heat will eventually cause insulation decomposition and excessive pressure conditions within the metallic sheath that will ultimately burst the hermetic seal.

It is an object of the invention to provide an improved electrical cable which is resistant to extreme concentrated heat conditions of the environment, for example, an open fire, and which mitigates the effect of, and structurally restricts the movement of, the derivatives of insulation decomposition within the electrical cable.

The object of the invention is obtained by providing a core assembly including at least one insulated conductor, a hermetically closed tubular metallic sheath concentrically positioned about the core assembly, and a filler material dispersed in, and partially occupying, the spaces between the inner surface of the metallic sheath and the outer surfaces of the core assembly throughout at least a major portion of the length of the electrical cable. The improvement comprises the following combination of features: (i) the metallic sheath tightly engages the core assembly along at least a major portion of the length of the core assembly, thus structurally limiting the hollow or unoccupied spaces within the electrical cable; and (ii) the filler material is comprised of a thermoplastic admixture which emits extinguishing oxides, and expands in volume, upon its temperature exceeding a predetermined limit. Upon the continued subjection of a segment of the metallic sheath to concentrated heat; e.g., a localized fire, extinguishing oxides are emitted from the filler material positioned within the heated segment, which combine with at least a portion of the acids and gases resulting from insulation decomposition and, in combination, the volume of such filler material within the heated segment, expands to provide substantially complete cross-sectional occupation of any hollow spaces within the heated segment, resulting in a structural blockage to the longitudinal flow of acids and gases from within the heated segment into adjacent segments of the electrical cable.

The invention will be further described with respect to the accompanying drawings, wherein.

Figure 1:
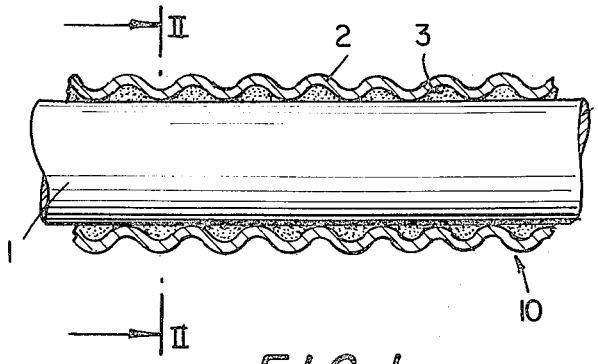
FIG. 1 is a longitudinal elevation view with parts in section, showing an embodiment of an electrical cable employing the present invention.
Figure 2:
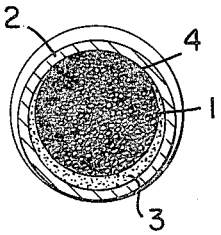
FIG. 2 is a transverse sectional view taken on the line II—II of FIG. 1.

Referring to FIGS. 1 and 2, there is illustrated an electrical cable 10 comprising a core assembly 1 formed of a plurality of insulated conductors 4. The insulation encapsulating the insulated conductors 4 is of the usual type, for example, paper or plasticized polyvinyl chloride. A corrugated tubular metallic sheath 2 is concentrically positioned about the core assembly 1 in a manner to provide a tight engagement between the outer surface of the core assembly 1 and the interior surfaces of the corrugations of the metallic sheath 2.

The metallic sheath 2, comprised preferably of aluminum, is of the type that is fabricated by known methods of continuously forming a longitudinal strip into a tubular configuration concentrically about the core assembly 1, welding the opposite longitudinal edges of the strip so formed to provide a hermetically sealed longitudinal seam, then transversely corrugating the metallic sheath 2 into engagement with the outer surface of the core assembly 1. During such sheath forming procedure, a filter material 3 is dispersed within the spaces between the inner surface of the metallic sheath 2 and the outer surfaces of the insultated conductors 4, including the intermediate spaces between such conductors. The filler material 3 is comprised of a thermoplastic admixture processed into minute granules, having the following combination of characteristics when subjected to elevated temperatures:

(i) generate extinguishing oxides that combine with corrosive and poisonous acids and gases; and (ii) expands in volume.

These characteristics are particularly present in thermoplastic admixtures containing carbonates, for example, ammonia carbonate, magnesia and sodium carbonates. Under normal temperature conditions, the filler material 3 only partially occupies the hollow or unoccupied spaces within the metallic sheath 2.

Examples of thermoplastic admixtures appropriate for employment as filler material 3 are as follows:

Example 1

100 parts silicon rubber (caoutchouc on the base of polydimethylsilicon)
200 parts basic magnesiumcarbonate (magnesia alba)
100 parts ammoniumbicarbonate.

Example 2

100 parts ethylene-propylen-rubber (caoutchouc)
300 parts basic magnesiumcarbonate (magnesia alba)
100 parts ammoniumbicarbonate.

Upon the temperature of a longitudinal segment of the hermetically sealed, metallic sheath 2 of the electrical cable 10, exceeding a predetermined temperature, for example, because of the sheath being subjected to fire, the interior of the electrical cable 10 is initially protected as the result of the efficient longitudinal heat conductance of the metallic sheath. However, as the fire continues, a significant portion of the heat will be transmitted to the interior of the electrical cable 10. Upon the temperature of the filler material 3 within the heated cable segment exceeding a predetermined value, extinguishing oxides emitted from the filler material 3 are made available for combination with a major portion of the corrosive poisonous acids and gases that result from the decomposition of the insulation material encapsulating the insulated conductors 4. Initially the circumferential mechanical strength of the hermetically sealed, metallic sheath 2 is sufficient to withstand the increasing internal pressures resulting from the decomposition of the insulating material. As the filler material 3 is so structured that its volume expands as a consequence of the increased temperature, and in view of the tight fit or engagement between the core assembly 1 and the metallic sheath 2, the expanded filler material provides for substantially complete, cross-sectional occupation of the previously hollow or unoccupied spaces between the metallic sheath 2 and the core assembly 1, within the heated longitudinal segment. Consequently, the longitudinal flow of acids and gases to other segments of the electrical cable 10 is substantially blocked.

Although the metallic sheath 2 of the electrical cable 10 provides initial excellent protection because of its efficient, longitudinal heat conductance, against any localized concentration of heat; e.g., a fire, the continued application of such heat will cause insulation decomposition and excessive pressure conditions within the metallic sheath 2 that will ultimately burst the metallic sheath 2. Prior to this eventuality, the major portion of the corrosive and poisonous acids and gases resulting from the decomposition of the insulation, combine with the extinguishing gases emitted from the heated filler material 3. If the metallic sheath 2 bursts at a particular location along the electrical cable 10, the uncombined gases from the decomposition of the insulation material escapes into the surroundings, but the cross-sectional blockage resulting from the aforesaid expanded filler material 3 within the heated segment of the electrical cable 10 prevents the longitudinal spread of the fire within the electrical cable 10.

Figure 3:
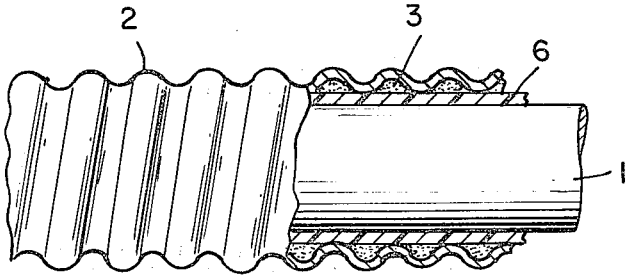
FIG. 3 is a longitudinal elevation view with parts in section, showing a second embodiment of an electrical cable employing the present invention.

The embodiment of the instant invention illustrated by FIG. 3 differs from that of FIG. 1 only in that a tubular member 6 of plasticized material is disposed between the metallic sheath 2 and the core assembly 1. The filler material 3 is initially dispersed within the spaces between the inner surface of the metallic sheath 2 and the outer surface of the tubular member 6, and between the inner surface of such tubular member 6 and the interposed surfaces of the insulated conductors 4. As in the case of the embodiment of FIG. 1, the metallic sheath 2 is corrugated so as to provide a tight fit or engagement with the interior components of the electrical cable 10, thus providing a confined hollow or unoccupied space within the electrical cable for achieving lateral blockage upon expansion of the filler material 3.

Numerous modifications and variations of the present invention are possible in light of the teachings and, therefore, within the scope of the appended claims. In particular, the metallic sheath may have a smooth rather than corrugated tubular configuration, the necessary tight fit or engagement with the interior components of the electrical cable being achieved by reducing the inner diameter of the metallic sheath by the employment of a conventional draw down procedure.

We claim:

1. An electrical cable comprising a core assembly including at least one insulated conductor, a hermetically closed, tubular metallic sheath concentrically positioned about said core assembly, and a filler material dispersed in and partially occupying, the spaces between the inner surface of said metallic sheath and the outer surfaces of said core assembly throughout at least a major portion of the length of said electrical cable, the improvement comprising:

(i) said metallic sheath tightly engaging said core assembly successively along at least a major portion of the length of said core assembly, thus structurally limiting the hollow or unoccupied spaces within the electrical cable; and (ii) said filler material being comprised of a thermoplastic admixture which absorbs at least a portion of acids and gases resulting from a decomposition of the insulation of said at least one conductor, and expands in volume upon its temperature exceeding a predetermined limit;

whereby, upon the continued subjection of a segment of said metallic sheath to concentrated heat, at least a portion of the acids and gases resulting from insulation decomposition is absorbed from said filler material within said heated segment, and the volume of said filler material within said heated segment expands to provide substantially complete cross-sectional occupation of any hollow spaces within said heated segment, resulting in a structural blockage to the longitudinal flow of acids and gases from within said heated segment into adjacent segments of said electrical cable.

2. An electrical cable in accordance with claim 1, wherein the core assembly comprises a plurality of insulated electrical conductors and a smooth tubular member concentrically positioned about and in engagement with said plurality of insulated conductors.

3. An electrical cable in accordance with claim 1, wherein the filler material is comprised of a thermoplastic admixture of carbonates.

4. An electrical cable in accordance with claim 1, wherein the filler material is comprised essentially of 100 parts of silicon rubber, 200 parts of basic magnesiumcarbonate and 100 parts of ammoniumbicarbonate.

5. An electrical cable in accordance with claim 1, wherein the filler material is comprised essentially of 100 parts of ethylene-propylen-rubber, 300 parts of basic magnesiumcarbonate and 100 parts of ammoniumbicarbonate.

* * * * *